United States Patent [19]

Ryerson

[11] 4,233,761

[45] Nov. 18, 1980

[54] EARTH DIGGING BUCKET TOOTH CONSTRUCTION HAVING A NOSE WITH INCREASED SECTION MODULUS

[75] Inventor: Robert W. Ryerson, St. Louis, Mo.

[73] Assignee: Page Engineering Company, Chicago, Ill.

[21] Appl. No.: 965,904

[22] Filed: Dec. 1, 1978

[51] Int. Cl.[3] ..... E02F 9/28

[52] U.S. Cl. ..... 37/142 R

[58] Field of Search ..... 37/141 R, 141 T, 142 R, 37/142 A; 172/699, 713, 719

[56] References Cited

U.S. PATENT DOCUMENTS

| | | | |
|---|---|---|---|
| 805,004 | 11/1905 | Cupples | 37/141 T |
| 1,837,341 | 12/1931 | Shaffer | 37/141 T |
| 2,227,674 | 1/1941 | Ratkowski | 37/142 R |
| 2,256,488 | 9/1941 | Murtaugh | 37/142 R |
| 2,921,391 | 1/1960 | Opsahl | 37/142 R |
| 3,012,346 | 12/1961 | Larsen | 37/142 A |
| 3,117,386 | 1/1964 | Ferwerda | 37/142 R |
| 3,196,956 | 7/1965 | Ratkowski | 172/699 X |
| 3,496,658 | 2/1970 | Eyolfson | 37/142 R |
| 3,675,350 | 7/1972 | Mulcahy et al. | 37/142 A |
| 3,881,262 | 5/1975 | Cullen | 37/142 R |
| 3,897,642 | 8/1975 | Helton et al. | 172/713 X |

*Primary Examiner*—Clifford D. Crowder

*Attorney, Agent, or Firm*—Wegner, Stellman, McCord, Wiles & Wood

[57] ABSTRACT

An earth digging bucket toothpoint construction with a tooth base having a tooth holder removably attached thereto and a toothpoint removably secured to the tooth holder in which an internal rib structure on noses of the interfitting parts with mating grooves in the interfitting parts of a particular specified size increases the section modulus against bending stresses to increase the bending strength of the noses against breakage.

9 Claims, 6 Drawing Figures

EARTH DIGGING BUCKET TOOTH CONSTRUCTION HAVING A NOSE WITH INCREASED SECTION MODULUS

BACKGROUND OF THE INVENTION

Extremely large earth digging buckets, such as used in dragline and large shovels, have increased in size to the point where many such buckets dig upwardly of 100 cubic yards of earth in a single bite. Such buckets have an open front with a digging lip at the bottom equipped with forwardly projecting teeth to aid in penetrating the earth in loading the bucket. The teeth on the bucket digging lip are cast metal of a type which is resistant to abrasion, yet, in use, the severe circumstances of operation do wear the teeth, requiring replacement from time to time to maintain the bucket's efficiency in digging. In many typical installations, a tooth base is welded to the bucket lip and extends forwardly therefrom, and has a nose part at the front upon which a tooth holder is removably mounted. This holder, in turn, has a nose part at its front upon which a replaceable toothpoint is held with a fastener in such a fashion that it can be replaced. The assemblage of the tooth base holder and toothpoint extend forwardly from the bucket lip a considerable distance. In a 60 cubic yard size bucket, this assembly may extend typically about 26" forwardly of the cutting lip of the bucket, and for a 120 cubic yard size the extension of the assemblage may be as much as 30" in front of the bucket lip. These teeth are subject to quite large stresses even though the parts are quite large and quite heavy. In the larger size, a typical 10" wide toothpoint would weigh as much as 150 pounds, its mounting holder about 390 pounds, and the tooth base welded to the bucket lip as much as 850 pounds. The size and the weight of the teeth is such that it is desired not to increase the same to provide resistance to breakage. The abrasion on the toothpoint is such that experience has taught that toothpoints are replaced in about a 4:1 ratio to the tooth holder. Even though the parts are quite large and heavy, experience has also indicated that breakage of the assembly most often occurs at the base of the toothpoint where the tooth holder nose will be fractured in its largest section at the base of the nose. It would be desirable to provide internally of the assembly of the toothpoint to its holder, a structure which would be more resistant to this breakage.

In the past, various attempts have been made to design the internal fitting parts of a tooth and its base to adequately resist the forces to which it is applied in use. Typical of such attempts are interfitting tangs and grooves, such as shown in U.S. Pat. No. 2,483,032; the provision of a spherical interfitting surface between the parts to reduce bending stresses, such as shown in U.S. Pat. No. 2,919,506; an arrangement of contact areas between a tooth and its support in an attempt to prevent force reaction and stress concentration points, such as shown in U.S. Pat. No. 3,508,352; and the provision of multiple fastening devices between a tooth and its base to reduce stresses, such as shown in U.S. Pat. No. 3,774,324.

SUMMARY OF THE INVENTION

It has been found in a dragline bucket tooth structure, by the provision of internal structural changes between a toothpoint socket and the nose of a toothpoint adapter to which it is interfitted, that the section modulus of the base of the nose on the adapter may be increased against bending stresses, a considerable amount without requiring an overall larger size or weight of tooth. By making the internal changes in what has been a typically used tooth on large dragline buckets, resistance to breakage has been achieved.

It is the principal object of this invention to provide the internal structure between a digging toothpoint and its tooth holder so as to resist bending stresses against breakage without materially increasing the overall size of the tooth and its mounting base.

It is a detailed object of this invention to provide a nose upon a tooth holding adapter or holder with raised ribs, particularly at the base of the nose, so as to increase the section modulus of the nose by about 18 to 23% over typical constructions, all without materially increasing the overall size of the toothpoint or its mounting adapter.

DESCRIPTION OF THE PREFERRED EMBODIMENT

Figure 1:
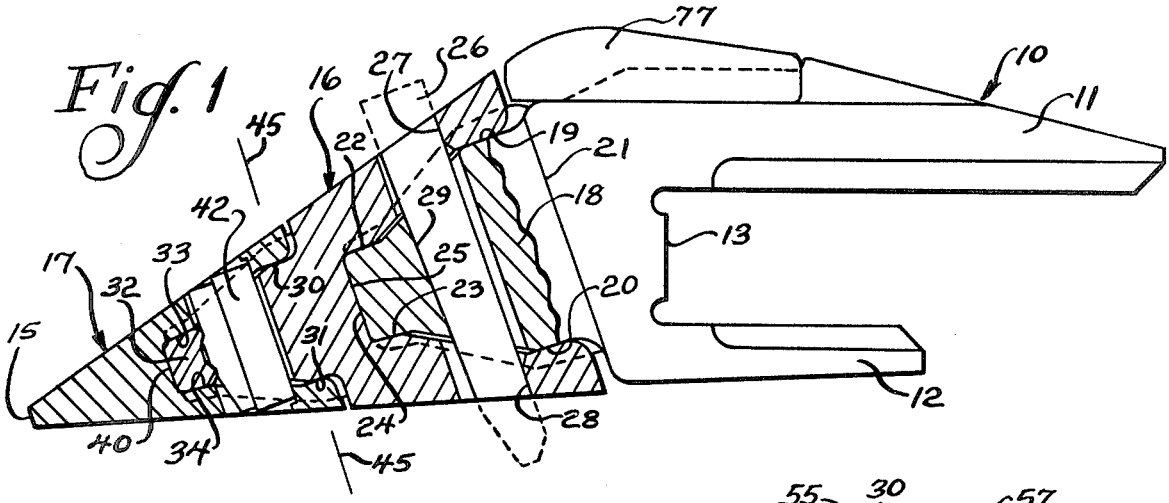
FIG. 1 is an upright side view of an assembled tooth base, a toothpoint holder and replaceable toothpoint, with the holder and toothpoint being in section to better illustrate the fastening devices for holding the assembly together.

Referring to the assembly of a toothpoint illustrated in FIG. 1, the tooth base 10 has a rearwardly extending part 11 spaced from a lower rearwardly extending part 12 to embrace the lip of a dragline bucket, which lip would abut the end surface 13 within the holder. This holder is welded to the bucket lip, it being understood that a 120 cubic yard bucket would have several such teeth, spaced one from the other, along the length of the digging bucket lip. In the size illustrated, the holder base would weigh about 850 pounds and the distance from the surface 13 in the base to the outer end 15 of the digging lip would be a distance of about 29 to 30". Mounted upon the tooth base is a toothpoint holder 16 to which a replaceable toothpoint 17 is, in turn, mounted. The tooth base is provided with a nose portion 18 generally of a wedge shape in which the nose might be typically about 10" wide with only a sufficient draft on the sidewalls to be properly cast. Important surfaces on the nose are those which support the toothpoint adapter 16, and in this case there is provided a flat planar surface 19 across the top of the nose, a similar flat surface 20 across the bottom of the nose in the base section adjacent the juncture 21 of the nose and the body of the base. The nose has a smaller extremity including similar flat surfaces 22 across the top surface of the nose and a similar flat surface 23 across the bottom of the nose part and an upright flat end surface 24. It is the surfaces 19, 20, 22 and 23 which mate with corresponding flat surfaces within the socket of the toothpoint holder 16 which mounts the holder to the base. When these surfaces within the socket of the holder 16 engage upon the surfaces on the base nose, as will occur as the holder is moved longitudinally over the nose, the surface 24 on the end of the nose should abut the corresponding surface 25 at the base of the socket in the holder. A very large pin 26 may be driven in central openings, such as opening 27 (FIG. 4) in the holder and through a mounting hole in the nose of the base to drive the holder upon the nose of the base. It may be noted that the pin engages particularly against surface 27 at the top of the holder, surface 28 at the bottom of the holder and the surface 29 within the opening provided through the center of the nose on the tooth base. Typically, upon installation on a digging bucket, the assembly of the tooth holder and the replaceable toothpoints will be made substantially as illustrated in FIG. 1. A pin, such as 26, will be driven through the openings of the holder and base nose and allowed to protrude, as illustrated in the dotted lines above and below the holder in FIG. 1, and perhaps even utilized through an 8-hour working shift. Thereafter, an attempt to drive the pins further to more tightly wedge the holders upon the tooth bases will be made, whereupon the dotted portion of the pins may be torched off and welding performed to secure the pins in place. At some later time, should the tooth holder have to be replaced, the welds would be chipped away in order to allow the pin to be driven backwardly out of the hole, permitting the removal of the holder.

Figure 2:
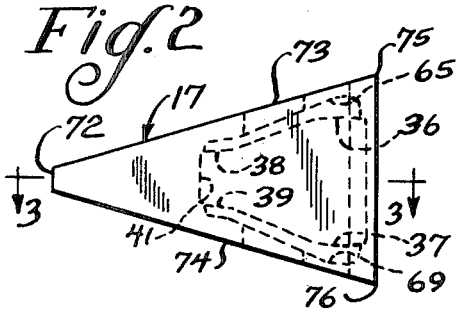
FIG. 2 is a side elevational view of a replaceable toothpoint showing its socket in phantom.
Figure 3:
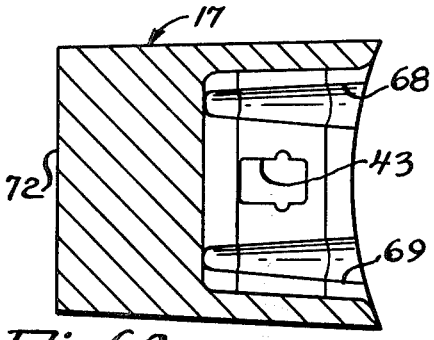
FIG. 3 is a sectional view through the center of the replaceable toothpoint of FIG. 2, taken substantially along line 3—3 in FIG. 2.
Figure 4:
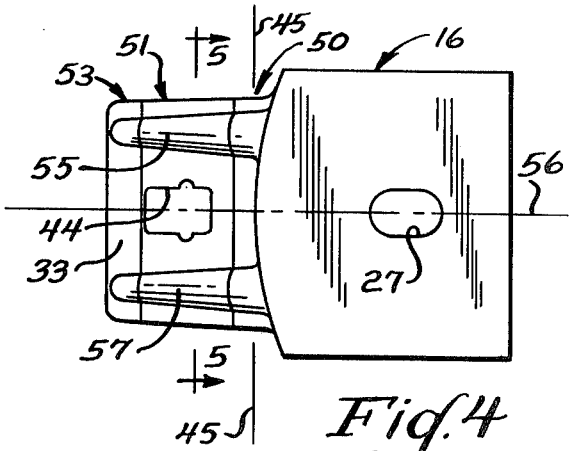
FIG. 4 is a plan view of the toothpoint holder illustrated in FIG. 1, for cooperation with the replacement toothpoint of FIGS. 2 and 3.

In the typical illustration of the invention as shown in FIG. 1, the replaceable toothpoint has a socket which is mounted upon a nose on the tooth holder 16 similar in configuration to the holder nose. This nose is also equipped with planar surfaces across the nose on the upper side near the base of the nose, such as surface 30 and a planar surface 31 at the bottom. The nose also tapers to an end portion 32 also equipped with planar surfaces 33 on the top and 34 on the bottom, which are the mounting surfaces between the toothpoint and the base. The socket within the toothpoint is provided with complementary planar surfaces (FIG. 2), such as 36, which mates with a surface 30 on the nose; surface 37 which mates with the surface 31 on the bottom of the nose near its base part, as well as surface 38 to mate with surface 33; and surface 39 to mate with surface 34. Once the toothpoint is placed over the nose on the tooth holder, it may be pounded lengthwise over the nose until the surfaces mentioned come into face to face contact. At this point in the assembly, the blunt end surface 40 on the nose of the holder should engage the mating and socket surface 41 within the socket of the toothpoint. In the assembly, a composite metal and rubber retaining pin 42 is mounted through aligned upper and lower holes in the toothpoint, such as illustrated at 43 (FIGS. 3 and 6) and a corresponding opening in the nose of the opening 44 in the nose of the holder (FIG. 4). This composite pin provides a constant urging of the toothpoint upon the nose of the tooth holder. Typically, in the size of tooth illustrated, the nose on the tooth holder is about the same width as the nose on the tooth base, but obviously of smaller thickness in an upright direction. Typically, in the size illustrated, the width of the base portion of the nose on the holder taken along a plane illustrated by the lines 45 (FIGS. 1 and 4) is about $10\frac{1}{4}''$ in width by $5\frac{1}{2}''$ in depth. It is the experience in the field that bending stress failures resulting in breaking of the tooth holder most often occurs at about the plane indicated by the lines 45. The present invention provides a solution for such breakage without materially increasing the outer dimensions of the toothpoints, their holders or bases.

It has been found that not only may the moment of inertia of the section at the plane 45 be increased, but that the section modulus which provides additional strength against bending failure may be increased by placing ribs lengthwise over the nose portions of a certain relative size to the size of the nose itself. The construction of the ribs must be chosen to provide an increase in section modulus, whereas some ribs of improper size and location can result in a reduction of the resistance to bending. In the present invention, it is preferred to provide the nose of the holder with a pair of ribs which extend over the base part 50 of the nose through the transition section 51 and onto the extremities portion 53 (FIG. 4). It is preferred that one such rib 55 be provided to one side of the centerline 56 and another such rib 57 be provided on the other side of the centerline 56, such centerline being that through the center of the tooth holder.

Figure 5:
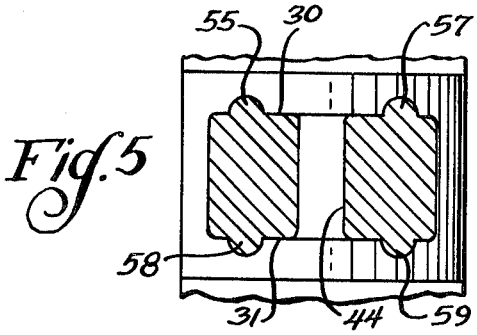
FIG. 5 is a sectional view through the nose portion of the holder, taken substantially along the line 5—5 in FIG. 4, and turned 90° for upright illustration and with the rearward parts of the holder broken away.

Referring to FIG. 5, it may be noted that the rib 55 extends upwardly from the upper flat surface 30 and an opposite lower rib 58 extends outwardly from the lower surface 31 on the nose. On the right-hand side, the rib 57 likewise extends upwardly from the surface 30 and a lower opposite counterpart 59 extends outwardly from the surface 31. These ribs, at the base section 50 of the nose, may most appropriately have a semi-circular cross sectional shape. The diameter of the cross section should be of the order of at least 1" and preferably $1\frac{1}{4}''$ for a $10\frac{1}{4}''$ wide nose, where the upright thickness of the nose at the base section is about $5\frac{1}{2}''$. It has been found that a smaller diameter rib, such as $\frac{1}{2}''$, will actually reduce the section modulus and thus the strength against bending by about 7.2%. The 1" diameter ribs actually increase the resistance to bending about 6% and the $1\frac{1}{4}''$ ribs increase such resistance by 19.9% in the size of tooth and nose referred to.

Again referring to FIGS. 3 and 4, it is acceptable that the ribs, such as 55 and 57, begin at the base section 50 of the nose with the full diameter and be decreased gradually to a lesser diameter of the order of one-half size at the section over the surface 33. Within the toothpoint, grooves are cast to mate with the ribs, such as the groove 68 which will mate with the rib 58 and the groove 69 to mate with the rib 59. Similar grooves are formed in the upper portion of the toothpoint socket to mate with the upper ribs 55 and 57 on the nose, such as illustrated by the phantomed groove 65 (FIG. 2), which would mate, one each, for the ribs 55 and 57. Thus, it has been found that increased strengthening against bending stress failures can occur by the providing of ribs extending lengthwise over the nose portions of the holder. Semi-circular section is not the only shape acceptable, though easy to accomplish. A square rib is acceptable and would be rounded at the corners to allow mold formation and avoid stress concentration at the outer edges of the rib. Heighth of such "square" ribs should be at least equal to the heighth of semi-circular section ribs.

Figure 6:
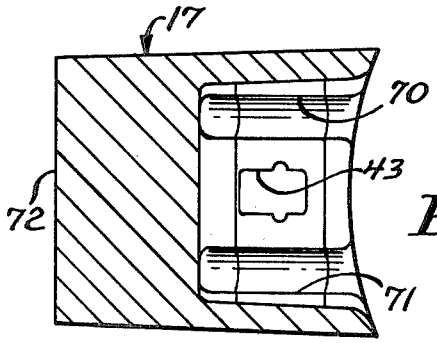
FIG. 6 is a view of a replaceable toothpoint similar to FIG. 3, illustrating an alternate construction of the rib and grooves therein.

Referring to FIG. 6, an alternate form of the toothpoint is shown in which the same size of tooth is provided with generally constant size grooves 70 and 71 to fit over similar constant size ribs provided upon a mating nose portion on a holder. It should be understood that sufficient draft must be provided in both the grooves and the ribs for their removal from casting molds. The toothpoints shown in FIG. 2 typically may have a blunt end 72 of about ¾" thickness by 12" in width. The upper surface 73 and lower surface 74 of the tooth take the brunt of abrasion in the digging process, so that the dimension from the upper rear corner 75 to the lower corner 76 of the tooth may typically be about 8½". Such a toothpoint would weigh about 150 pounds, and should be reversible 180° so that either the surface 73 or 74 is uppermost as it is installed on the typical toothpoint holder nose.

A similar construction to that described in detail for the nose of the holder may be applied to the nose of the tooth base where it interfits into the socket of the holder. As illustrated in FIG. 1 by the dotted lines above the surfaces 19, 20, 22 and 23, similar ribs to those illustrated in FIGS. 4 and 5 are provided. Such ribs on the nose 18 of the toothpoint base are formed of the same relative size extending longitudinally over the upper and lower mating surface with similar grooves formed in the socket of the holder to fit thereover. Completing the assembly illustrated in FIG. 1 is a removable wear plate 77 which is subject to much abrasion because most of the material loaded into the bucket passes thereover. This wear plate is removable and replaceable upon the removal of the tooth holder 16 from the nose of the tooth base.

By providing strengthening ribs on the nose of the tooth base and on the nose of the tooth holder where such ribs are provided one on each side of the centerline through the assembly and are semi-circular in cross section with a section diameter at the base of the nose in a ratio of the order of 1" to 1¼" for a nose base having an upright thickness of 5½" and a width of 10¼", it has been found that the additional strengthening against bending is increased about 20% over the structure without such ribs. The cross-sectional height of the rib effective to provide the increased sectional modulus against bending stress is about 18 to 23% of the depth of the nose of 5½" at the critical plane. Such size of ribs in the relative size of the parts described does not require additional material on either the tooth holder 16 or replaceable toothpoint 17 since there is sufficient metal over the ribs for operational strength. If desired, some additional metal over the ribs may be provided in the toothpoint in the nature of a raised smoothly contoured curved surface over the rib area. Thus, the toothpoint may be improved against the failures that have been experienced without adding material size or bulk to the tooth since the changes are all internal of the mating structures of the toothpoint to its holder and the holder to its tooth base.

I claim:

1. A toothpoint construction for an earth digging bucket, comprising:

a removable toothpoint of abrasion resistant metal having relatively wide diverging upper and lower walls and joining sidewalls together forming a hollow rearwardly open internal socket, a metal nose for reception of the toothpoint socket, said nose and socket each having complementary upper and lower mounting surfaces, said mounting surfaces being substantially planar and extending laterally across the nose at its base and adjacent its outer extremity both on the top and the bottom of the nose, and means for increasing the section modulus of the nose against bending failure consisting of semi-circular cross-sectional ribs outstanding from said planar mounting surfaces and extending lengthwise of the nose, one such rib being located at each side of the lengthwise center of the nose and being of the order in size at least one inch in diameter for a five and one-half inch thick nose, said toothpoint socket upper and lower walls having complementary grooves fitting over said ribs.

2. A toothpoint construction as specified in claim 1 in which each rib extends over the nose from its base to the extremity of the nose over both an upper and lower surface of the nose.

3. A toothpoint construction as specified in claim 2 in which each rib extends over the nose from its base to its extremity and diminishes in diameter about 50 percent uniformly from said specified diameter to the extremity.

4. A toothpoint construction as specified in claim 1 in which said nose is formed upon a removable holder secured to a tooth base on the earth digging bucket, said base having a nose similar in shape to the nose on said holder and said holder having a socket complementary and fitting over said base nose, planar complementary mounting surfaces extending laterally over the base nose and within the holder socket, and strengthening ribs extending lengthwise over the base nose, each rib having a diameter of the order in size substantially proportionally equal to the specified size of said holder nose ribs.

5. A toothpoint construction for an earth digging bucket lip, comprising:

a holder forming part of and extending forwardly from the bucket lip, an adapter removably secured over the holder and having a forwardly extending wedge-shaped nose with a given width at its base and slight side taper forwardly therefrom, a removable toothpoint secured to and embracingly enclosing the nose of the adapter, said point having a socket to receive the adapter nose and said nose and socket having complementary surfaces mating upon proper placements of the point over said nose, said nose and point socket having upper and lower said surfaces at the rear of the nose and upper and lower said surfaces at the outer end of the nose, the nose having a blunt end surface with the socket having a complementary socket bottom surface engaging the nose blunt end, and outstanding strengthening ribs extending in a forwardly and backwardly direction over the nose, at least two such ribs extending over the nose each having a cross-sectional height of the order of 18 to 23 percent of nose depth.

6. A toothpoint construction as specified in claim 5 in which each rib has a gradually diminishing radius of cross section from end to end of the rib with the larger radius at the nose base.

7. In an earth digging bucket tooth structure having removable and replaceable teeth, means for increasing section modulus against bending stress failures comprising:

a metal nose portion adapted to receive a mating socketed toothpoint, said nose having a base portion with upper and lower planar surfaces extending across the base and an extremity portion with upper and lower planar surfaces extending across the extremity with a tapered transition section between the base and extremity portions, a metal tooth structure part having a socket with planar surfaces arranged to engage and mate with said nose portion base and extremity planar surfaces for support of such part on such nose portion, a pair of spaced outstanding ribs extending lengthwise over the planar surfaces and means forming mating grooves in the socket, each said rib having a cross-sectional shape at the base of the nose equivalent to a semi-circular cross section in a ratio of the order of one to one and a quarter inch for a nose having an upright thickness of five and one-half inches and width of ten and a quarter inches.

8. An earth digging bucket tooth structure as specified in claim 7 wherein said tooth structure includes a tooth base secured to the earth bucket, a tooth holder mounted to the tooth base, and a toothpoint mounted to the holder, each of said tooth holder and said tooth base having said metal nose portion and said ribs.

9. An earth digging bucket tooth structure as specified in claim 8 wherein a fastener is mounted centrally through each nose and its socketed mating part and one such rib is located on either side of said central fastener.

* * * * *